US009364804B2

(12) United States Patent
Xia et al.

(10) Patent No.: US 9,364,804 B2
(45) Date of Patent: Jun. 14, 2016

(54) MICROFLUIDIC AGITATOR DEVICES AND METHODS FOR AGITATION OF A FLUID

(71) Applicant: Agency for Science, Technology and Research, Singapore (SG)

(72) Inventors: Huanming Xia, Singapore (SG); Zhiping Wang, Singapore (SG); Wei Wang, Singapore (SG)

(73) Assignee: Agency for Science, Technology and Research, Singapore (SG)

( * ) Notice: Subject to any disclaimer, the term of this patent is extended or adjusted under 35 U.S.C. 154(b) by 122 days.

(21) Appl. No.: 14/010,024

(22) Filed: Aug. 26, 2013

(65) Prior Publication Data

US 2014/0056096 A1 Feb. 27, 2014

(30) Foreign Application Priority Data

Aug. 27, 2012 (SG) ..... 201206345

(51) Int. Cl.
*B01F 13/00* (2006.01)
*B01F 11/00* (2006.01)

(52) U.S. Cl.
CPC ..... *B01F 13/0059* (2013.01); *B01F 11/0051* (2013.01)

(58) Field of Classification Search
CPC ..... B01F 11/0042; B01F 11/0045; B01F 11/0051; B01F 13/0059; F04B 43/043; B01L 3/50273
USPC ..... 366/DIG. 2, DIG. 3, 119, 165.1, 131
See application file for complete search history.

(56) References Cited

U.S. PATENT DOCUMENTS

| | | | | |
|---|---|---|---|---|
| 6,807,892 | B2 * | 10/2004 | Biegelsen et al. | 91/459 |
| 8,277,110 | B2 * | 10/2012 | Lee et al. | 366/134 |
| 2003/0141473 | A1 | 7/2003 | Pelrine et al. | |
| 2003/0165079 | A1 * | 9/2003 | Chen et al. | 366/165.1 |
| 2006/0076068 | A1 | 4/2006 | Young et al. | |
| 2011/0315227 | A1 * | 12/2011 | Shu | 137/1 |

FOREIGN PATENT DOCUMENTS

WO WO 2010097740 A1 * 9/2010

* cited by examiner

*Primary Examiner* — Tony G Soohoo
*Assistant Examiner* — Elizabeth Insler
(74) *Attorney, Agent, or Firm* — Winstead, P.C.

(57) ABSTRACT

According to various embodiments, a microfluidic agitator device may be provided. The microfluidic agitator device may include: an air inlet; an air outlet; an elastic diaphragm provided between the air inlet and the air outlet and configured to oscillate if an airflow from the air inlet to the air outlet is provided; and a chamber coupled to the elastic diaphragm.

16 Claims, 11 Drawing Sheets

MICROFLUIDIC AGITATOR DEVICES AND METHODS FOR AGITATION OF A FLUID

CROSS-REFERENCE TO RELATED APPLICATIONS

The present application claims the benefit of the Singapore patent application No. 201206345-9 filed on 27 Aug. 2012, the entire contents of which are incorporated herein by reference for all purposes.

TECHNICAL FIELD

Embodiments relate generally to microfluidic agitator devices and methods for agitation of a fluid.

BACKGROUND

Mixing of fluids in a microfluidic device may be desired. Thus, there may be a need for an efficient device for mixing of fluids in a microfluidic device.

SUMMARY

According to various embodiments, a microfluidic agitator device may be provided. The microfluidic agitator device may include: an air inlet; an air outlet; an elastic diaphragm provided between the air inlet and the air outlet and configured to oscillate if an airflow from the air inlet to the air outlet is provided; and a chamber coupled to the elastic diaphragm.

According to various embodiments, a method for agitation of a fluid in a microfluidic agitator device may be provided. The method may include: providing a fluid to be agitated in a chamber coupled to an elastic diaphragm; and providing an airflow through an air inlet to the elastic diaphragm provided between the air inlet and an air outlet.

BRIEF DESCRIPTION OF THE DRAWINGS

In the drawings, like reference characters generally refer to the same parts throughout the different views. The drawings are not necessarily to scale, emphasis instead generally being placed upon illustrating the principles of the invention. In the following description, various embodiments are described with reference to the following drawings, in which.

DESCRIPTION

Embodiments described below in context of the devices are analogously valid for the respective methods, and vice versa. Furthermore, it will be understood that the embodiments described below may be combined, for example, a part of one embodiment may be combined with a part of another embodiment.

Mixing of fluids in a microfluidic device may be desired. Thus, there may be a need for an efficient device for mixing of fluids in a microfluidic device.

As the liquid viscous forces become dominant in microfluidic devices, agitation/mixing of fluids may become difficult. Active methods may commonly be applied that require external resources and control components. In comparison, the devices according to various embodiments may have various advantages like described herein.

According to various embodiments, a robust passive agitation method and apparatus for microfluidic fluid manipulations, including flow patterns control, fluid mixing, stirring of solid particles, and particle focusing/enrichment may be provided.

According to various embodiments, a microfluidic agitation method and apparatus may be provided.

Figure 1A:
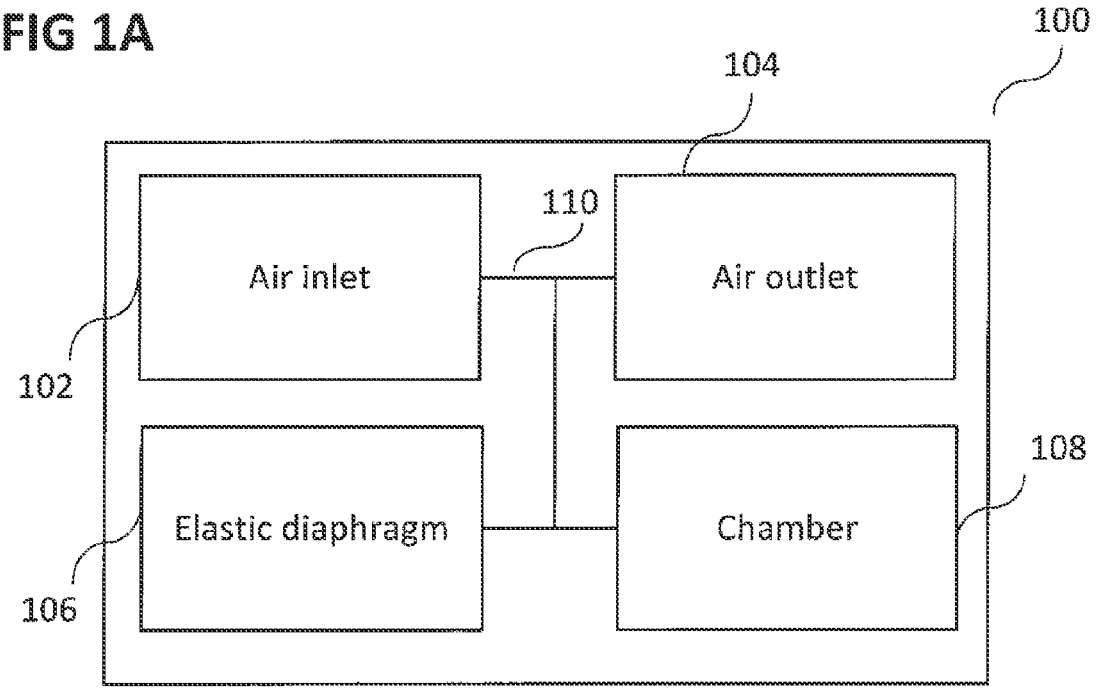
FIG. 1A shows microfluidic agitator device according to various embodiments.

FIG. 1A shows microfluidic agitator device 100 according to various embodiments. The microfluidic agitator device 100 (which may also be referred to as the device according to various embodiments) may include an air inlet 102 (for example an air inlet channel). The microfluidic agitator device 100 may further include an air outlet 104 (for example an air outlet channel). The microfluidic agitator device 100 may further include an elastic diaphragm 106 provided between the air inlet 102 and the air outlet 104 and configured to oscillate if an airflow from the air inlet 102 to the air outlet 104 is provided. The microfluidic agitator device 100 may further include a chamber 108 (for example a micro-chamber) coupled to the elastic diaphragm 106. The air inlet 102, the air outlet 104, the elastic diaphragm 106, and the chamber 108 may be coupled, like indicated by line 110, for example mechanically coupled. For example, the chamber 108 may be coupled with the elastic diaphragm 106, so that upon a movement of the elastic diaphragm 106, the content of the chamber 108 may be moved or agitated.

In other words, in the microfluidic agitator device 100 according to various embodiments, the chamber 108 may be affected by a movement of the elastic diaphragm 106, and this movement of the elastic diaphragm 106 may be caused by an airflow from the air inlet 102, to the elastic diaphragm 106, and the air outlet 104.

Figure 1C:
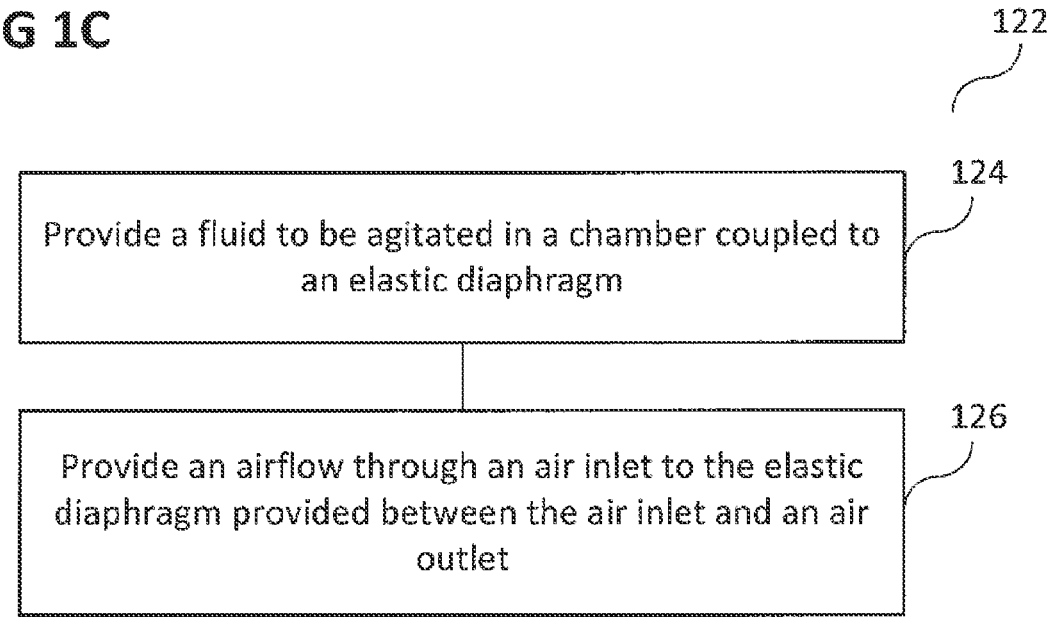
FIG. 1C shows a flow diagram illustrating a method for agitation of a fluid in a microfluidic agitator device according to various embodiments.
Figure 1B:
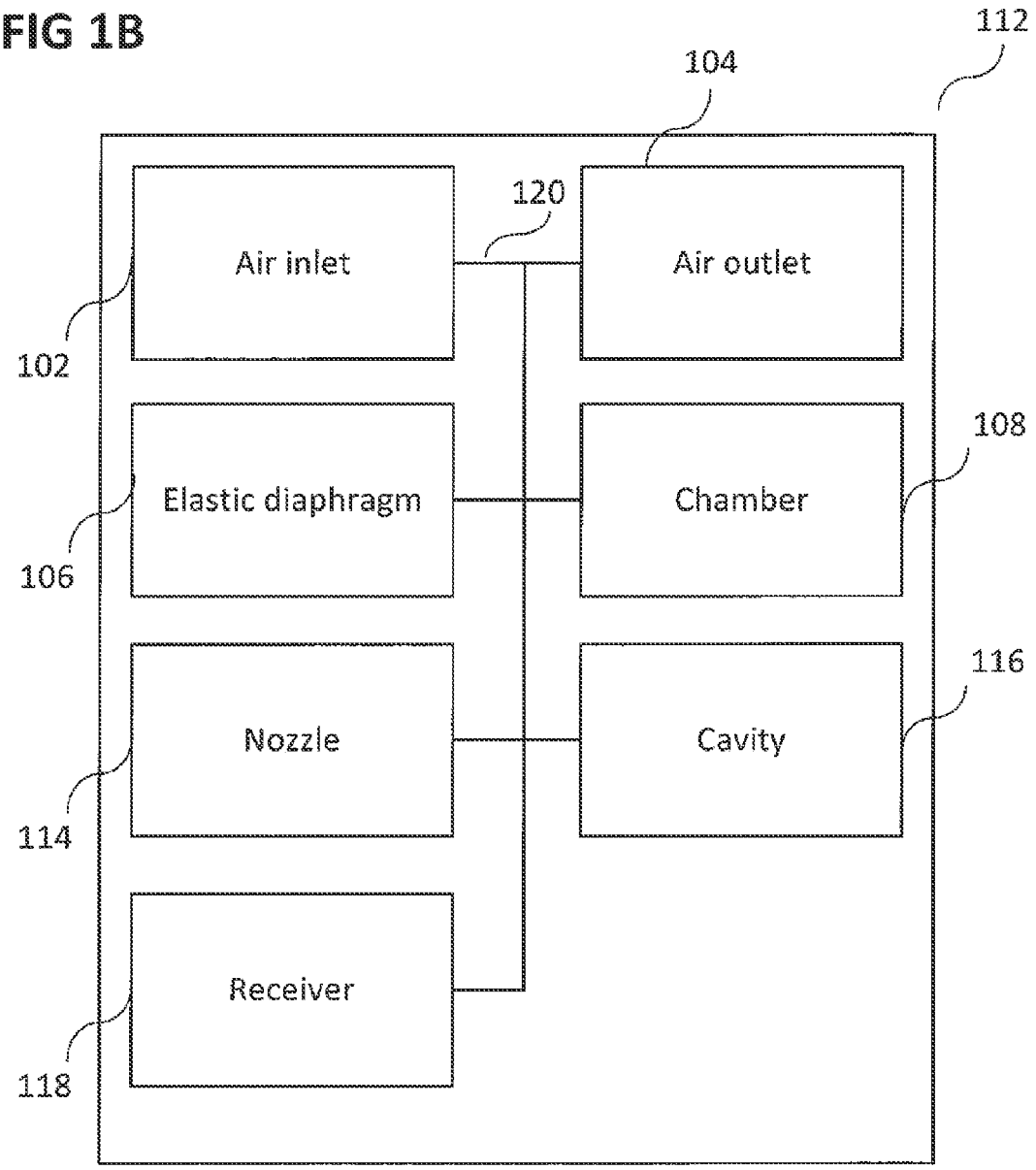
FIG. 1B shows microfluidic agitator device according to various embodiments.

FIG. 1B shows microfluidic agitator device 112 according to various embodiments. The microfluidic agitator device 112 may, similar to the microfluidic agitator device 100 of FIG. 1A, include an air inlet 102 (for example an air inlet channel). The microfluidic agitator device 112 may, similar to the microfluidic agitator device 100 of FIG. 1A, further include an air outlet 104 (for example an air outlet channel). The microfluidic agitator device 112 may, similar to the microfluidic agitator device 100 of FIG. 1A, further include an elastic diaphragm 106 provided between the air inlet 102 and the air outlet 104 and configured to oscillate if an airflow from the air inlet 102 to the air outlet 104 is provided. The microfluidic agitator device 112 may, similar to the microfluidic agitator device 100 of FIG. 1A, further include a chamber 108 (for example a micro-chamber) coupled to the elastic diaphragm 106. The microfluidic agitator device 112 may further include a nozzle 114 (for example a micro-nozzle), like will be described in more detail below. The microfluidic agitator device 112 may further include a cavity 116, like will be described in more detail below. The microfluidic agitator device 112 may further include a receiver 118, like will be described in more detail below. The air inlet 102, the air outlet 104, the elastic diaphragm 106, the chamber 108, the nozzle 114, the cavity 116, and the receiver 118 may be coupled, like indicated by line 120, for example mechanically coupled.

According to various embodiments, the elastic diaphragm 106 may be clamped between the nozzle 114 and the chamber 108.

According to various embodiments, the chamber 108 may be configured to hold a fluid to be agitated.

According to various embodiments, the elastic diaphragm 106 may include or may be made from silicone rubber, and/or natural rubber, and/or latex.

According to various embodiments, the elastic diaphragm 106 may be integrated with the nozzle 114.

According to various embodiments, the nozzle 114 and the air outlet 104 may include symmetrical geometrically structures.

According to various embodiments, the nozzle 114 and the air outlet 104 may include non-symmetrical geometrically structures.

According to various embodiments, an exit of the nozzle 114 may include or may be a plurality of orifices of different sizes.

According to various embodiments, the chamber 108 may be an open chamber.

According to various embodiments, the chamber may be a closed chamber.

According to various embodiments, the cavity 116 may be provided between the nozzle 114 and the chamber 108.

According to various embodiments, the nozzle 114 may be mountable to a supporting fixture with a thread track. According to various embodiments, the position of the nozzle 114 with respect to the elastic diaphragm 106 may be adjustable.

According to various embodiments, the nozzle 114 may include or may be at least partially made from an elastic material.

According to various embodiments, the elastic diaphragm 106 may be partially fixed. According to various embodiments, a portion of the elastic diaphragm 106 exposed to the air outlet 104 may be configured to deform under a pressure to form a flow conduit.

According to various embodiments, the receiver 118 may be configured to receive a chip. The chip may include the chamber 108.

According to various embodiments, an array of microfluidic agitator devices may be provided. The array may include a plurality of microfluidic agitator devices as described above and below.

FIG. 1C shows a flow diagram 122 illustrating a method for agitation of a fluid in a microfluidic agitator device according to various embodiments. In 124, a fluid to be agitated may be provided in a chamber coupled to an elastic diaphragm. In 126, an airflow may be provided through an air inlet to the elastic diaphragm provided between the air inlet and an air outlet.

According to various embodiments, the air flow may cause the elastic diaphragm to be deformed.

According to various embodiments, the air flow may cause the elastic diaphragm to oscillate.

According to various embodiments, the oscillation of the elastic diaphragm may cause agitation of the fluid in the chamber.

According to various embodiments, an elastic diaphragm is integrated in the microfluidic chip as an interface between the fluids and external agitator. Compressed air (or another gas source) may be used to drive the elastic diaphragm. Under the air flow, vibration may be produced through the aeroelasticity mechanism and the mechanical energy may be transferred into the liquids for specific manipulations.

Figure 2A:
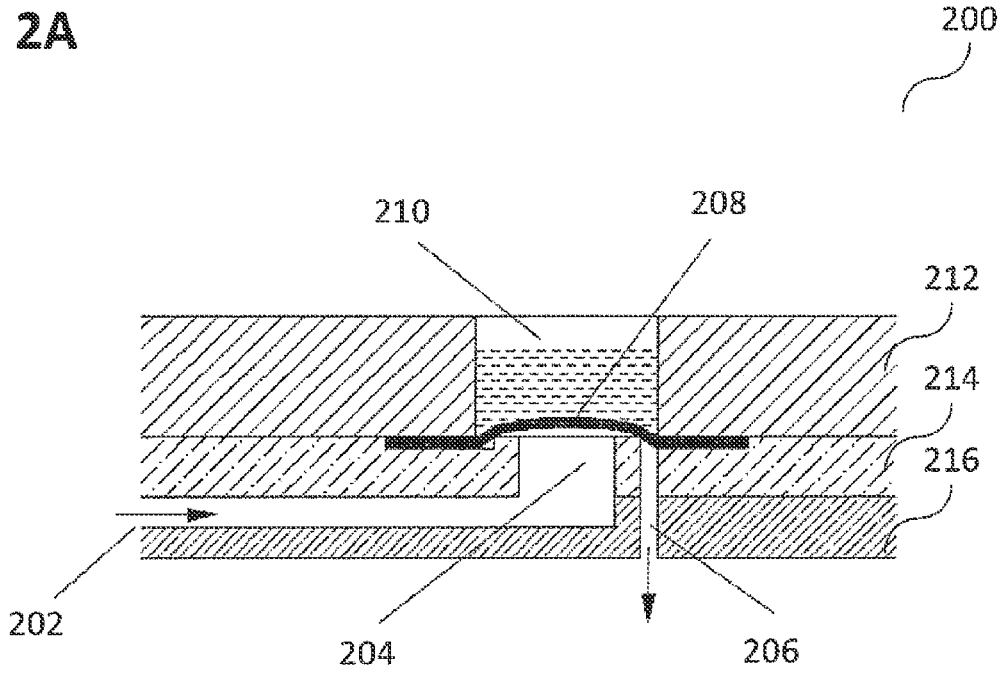
FIG. 2A to FIG. 2C show a structure of a microfluidic device including a micro agitator according to various embodiments.
Figure 2B:
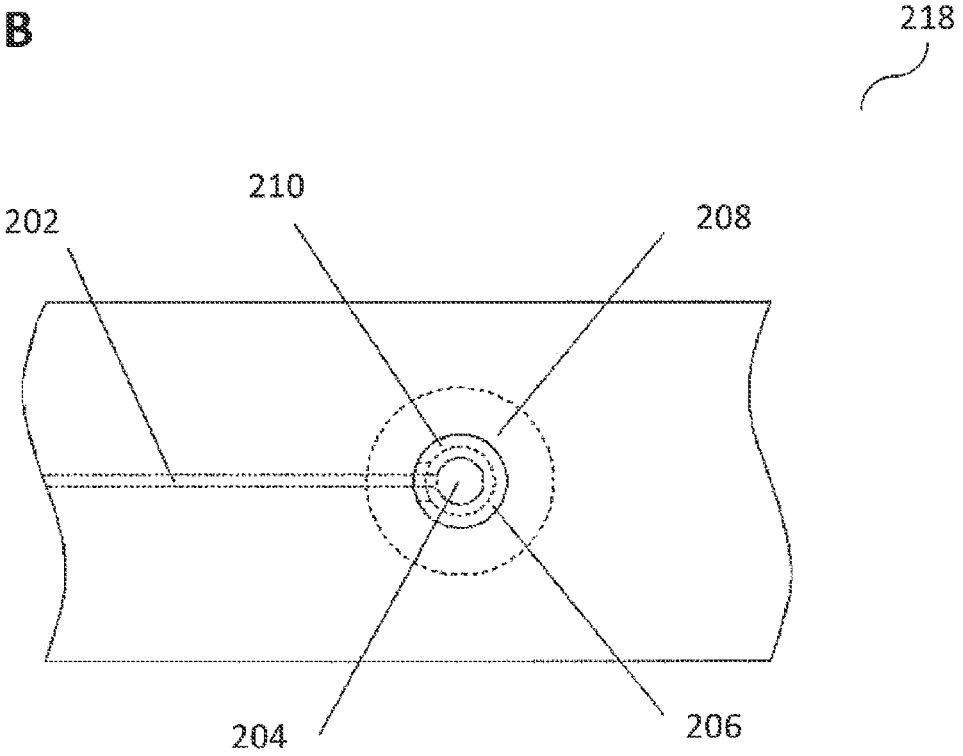
Figure 2C:
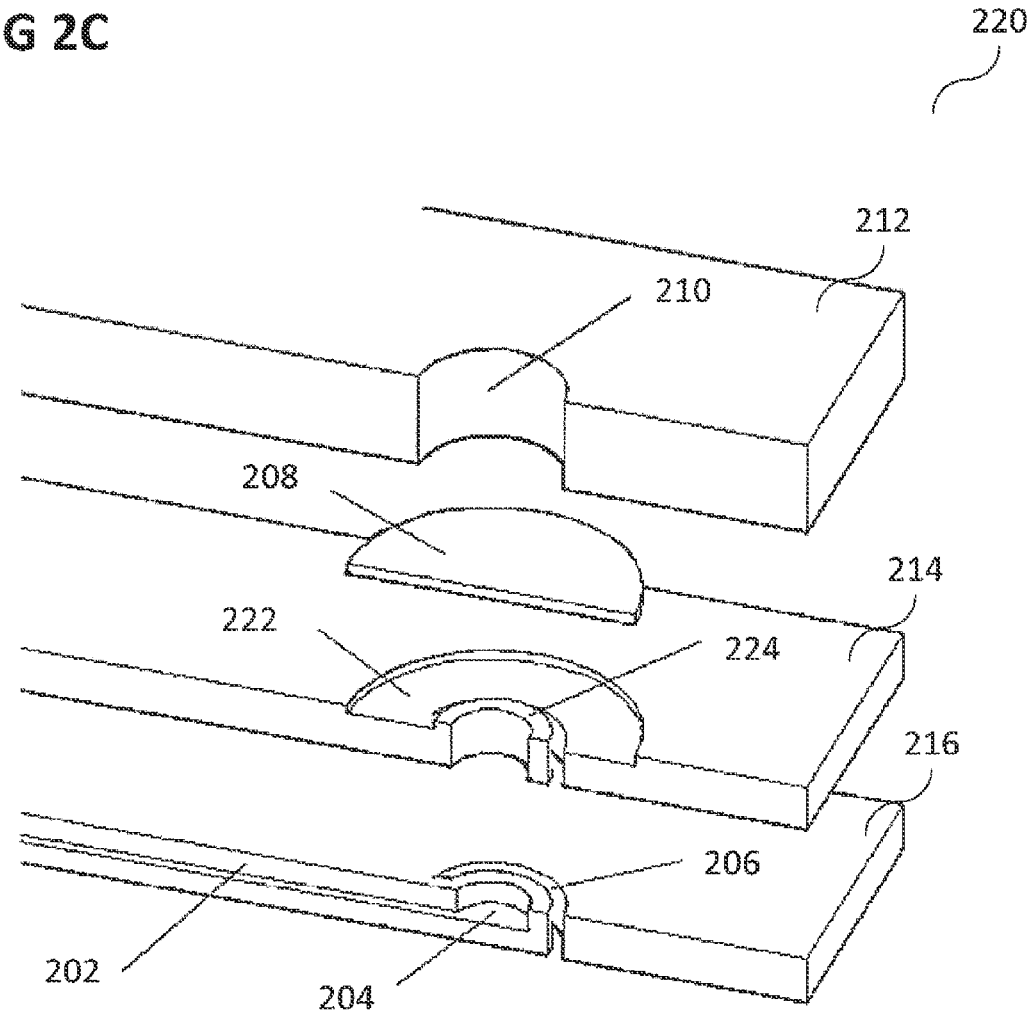

FIG. 2A to FIG. 2C show a structure of a microfluidic (agitation) device including a micro agitator according to various embodiments. In FIG. 2A, a front view 200 of a microfluidic device containing a micro agitator is shown. FIG. 2B shows a top view 218 of the (microfluidic) device. FIG. 2C shows a 3D (three-dimensional) and cross-sectional view 220 of the (microfluidic) device. An air inlet channel 202, a micro-nozzle 204, an air outlet 206, an elastic diaphragm 208, a micro-chamber 210, a cavity 222 for the diaphragm 208, and a protrusion 224 of the nozzle 204 are shown, which may be provided in a first substrate layer 212, a second substrate layer 214, and a third substrate layer 216.

It will be understood that for various devices shown herein (in FIG. 2A to FIG. 2C, and in the other figures), the device structure is illustrated in various layers because the fabrication of the device may be through a layer-by-layer process. However, it will be understood that with other suitable production methods, a different layer arrangement may be provided.

Around the exit of the nozzle 204, there may be the shallow cavity 222 which may be used to accommodate the elastic diaphragm 208. The nozzle 204 may or may not protrude above the bottom surface of the cavity 222, to form the protrusion 224, for example a circular rim 224. The micro chamber 210 may be located above the diaphragm 208.

According to various embodiments, the (microfluidic) device may work in two different modes. In one embodiment, there may be a small gap between the nozzle 204 and the diaphragm 208. When air is driven through the inlet channel 202 and flows out the nozzle 204, the elastic diaphragm 208 may be pushed away from the nozzle. The air may then flow radially over the bottom surface of the diaphragm 208 and may discharge to surrounding atmosphere through the opening 206. The gap between the nozzle 204 and the diaphragm 208 may be so small that the radial velocity of the air flow is accelerated in this section. According to the Bernoulli's equation $$P^* = P_0 + \frac{\rho V^2}{2},$$

at a constant total pressure P*, the static pressure $P_0$ may decrease with the increase of the air velocity. Then a force may be produced due to the pressure difference on the top and bottom surfaces of the diaphragm 208, pushing it back towards the nozzle 204. Once the nozzle 204 is blocked by the diaphragm 208, air flow may stop and the pressure may be built up. Or, the diaphragm 208 may be very close to (but will not block) the nozzle 204, so that air velocity V will be reduced due to increased flow resistance. As a result, the static pressure $P_0$ will build up again. Then the diaphragm 208 may be pushed away again from the nozzle 204 and air flow may resume. As this cycle may repeat itself, the diaphragm 208 may oscillate back and forth. At micro scales, the inertial force of the diaphragm 208 may become weak. It tends to stay at an equilibrium point. So it may become more difficult to produce oscillations.

In a further embodiment, the nozzle 204 may be pushed hard against the diaphragm 208. Thus it (for example the nozzle 204) may be sealed by the elastic force (for example of the diaphragm 208) whose magnitude may relate to the properties and deflection of the diaphragm 208. In this situation, a higher pressure may be required to push the diaphragm 208 away, and it may easily reach an inertia overshoot state. Once the nozzle 204 is open, the air may be released and the pressure may be reduced. Then the elastic force, together with the aerodynamic forces, may pull the diaphragm 208 back again towards the nozzle 204. Consistent vibrations may thus be produced. This embodiment may be very reliable. The oscillation frequency may depend on the elastic response of the diaphragm 208, for example at the level of several thousand Hertz. The agitation force may increase with the air pressure applied to drive the diaphragm 208. The threshold pressure $P_i$ where the oscillation starts may relate to the properties (for example Young's modulus) and the tension of the diaphragm 208. The latter may further relate to the height of the protrusion of the nozzle 224 or the force applied against the diaphragm 208. Higher Young's modulus and higher tension of the diaphragm may require larger $P_i$, and hence may produce stronger agitations.

Figure 3:
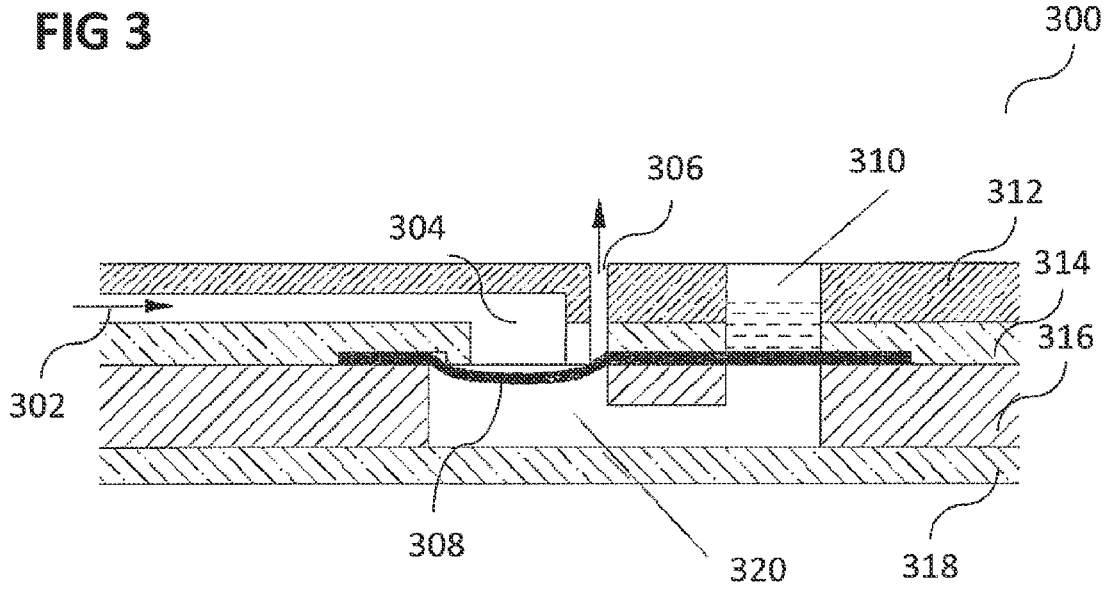
FIG. 3 shows a microfluidic agitator according to various embodiments.

FIG. 3 shows a microfluidic agitator (device) 300 according to various embodiments. An air inlet channel 302, a micro-nozzle 304, an air outlet 306, an elastic diaphragm 308, a micro-chamber 310, and a cavity 320 are shown, which may be provided in a first substrate layer 312, a second substrate layer 314, a third substrate layer 316, and a fourth substrate layer 318. The mechanical energy of the oscillating diaphragm 308 may indirectly be transferred to the mixing chamber 310 through the cavity 320. This embodiment may allow a flexible change of the chamber 310 size, and hence of the volume of the liquid under process.

According to various embodiments, the microfluidic agitator may also work as an independent and detachable component.

Figure 4:
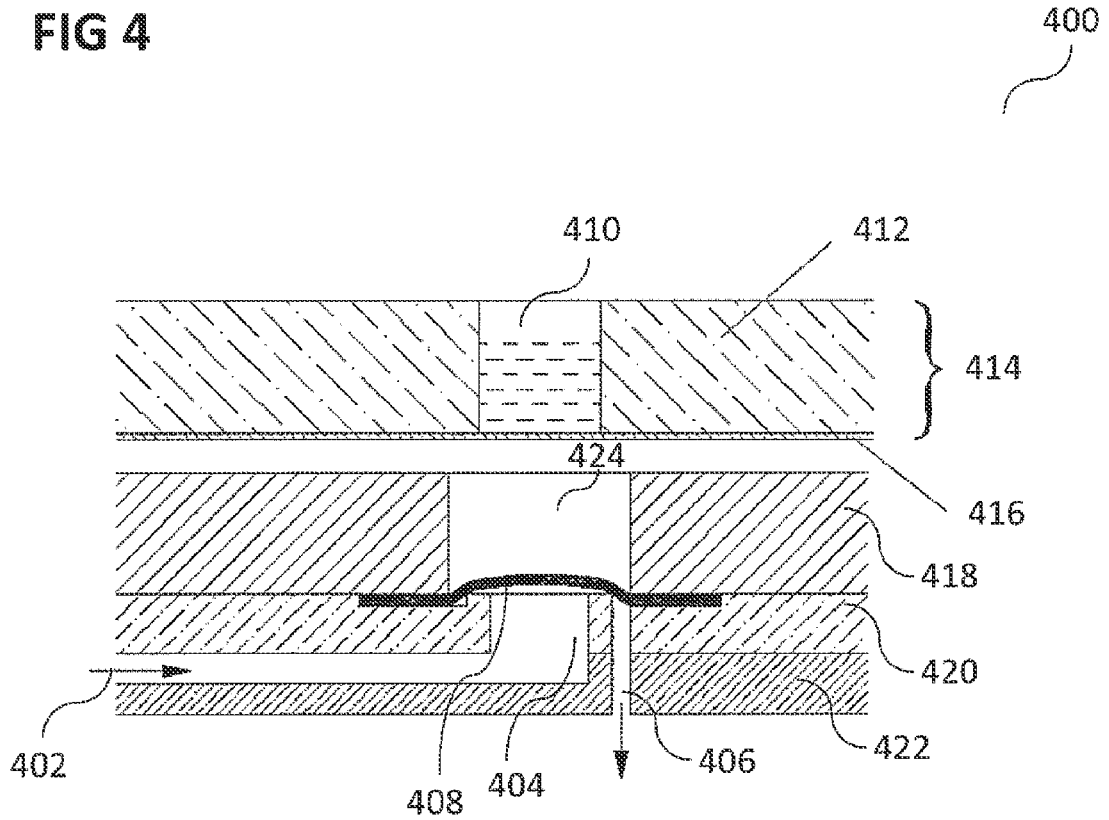
FIG. 4 shows a microfluidic device with a detachable design according to various embodiments.

FIG. 4 shows a microfluidic (agitator) device 400 with a detachable design where the agitator works as an independent component according to various embodiments. An air inlet channel 402, a micro-nozzle 404, an air outlet 406, an elastic diaphragm 408, a micro-chamber 410, and a cavity 424 are shown, which may be provided in a first substrate layer 412, a second substrate layer 418, a third substrate layer 420, and a fourth substrate layer 422. A chip 414 (for example including the micro chamber 410 in the first substrate layer 412) may be provided separated from the agitator (for example including the second substrate layer 418, the third substrate layer 420, the fourth substrate layer 422, the inlet 402, the outlet 406, the nozzle 404, the cavity 424, and the diaphragm 408) and may be used as a disposable one. A bottom layer 416 of the liquid chamber 410 may include or may be an elastic material similar to the oscillation diaphragm 408. It may also include or be a thin film of the same material as the chip substrate 412 (for example a 50 μm-thick film for example of Poly(methyl methacrylate) (PMMA) or Polycarbonate (PC)). In this way, the injection molding and thermal bonding techniques may be used to ease the fabrication process. Furthermore, as the material may be selectable for example among PMMA, PC, COC (Cyclic Olefin Copolymer), the possible applications may be greatly widened considering the issues of for example chemical resistance or biocompatibility.

Figure 5:
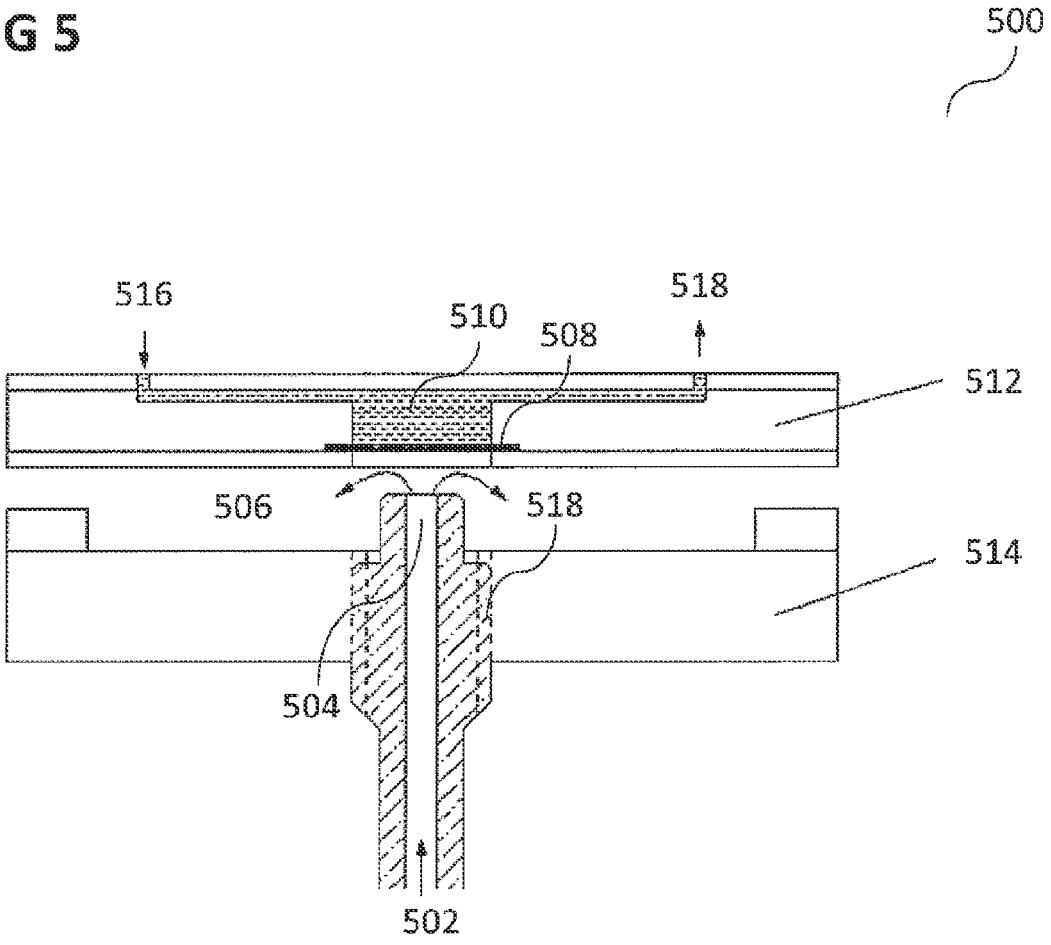
FIG. 5 shows a microfluidic device with a detachable design according to various embodiments.

FIG. 5 shows a microfluidic (agitator) device 500 with a detachable design where the agitation strength is adjustable according to various embodiments. A diaphragm 508, a micro-chamber 510, a fluid inlet 516 to the micro-chamber, and a fluid outlet 518 from the micro-chamber 510 are shown, which may be provided on a first substrate 512. An air inlet 502, air outlet 506, and a nozzle 504 are shown, which may be provided on a second substrate 514 (which may also be referred to as a platform 100).

According to various embodiments, the nozzle 504 and a supporting fixture may be used as the platform 514. The microfluidic chip (for example the first substrate 512) may be used as a disposable device. It may be attached to the agitator platform 514 for fluid processing, and then moved away. The nozzle 504 may be mounted to the fixture with a thread track 518. The force applied against the diaphragm 508 may be adjustable through screwing in and out of the nozzle 502.

According to various embodiments, the chamber may be either an open or closed one. Usually, due to the viscous effects, stronger agitations may be required for manipulating fluids in closed chambers.

Figure 6:
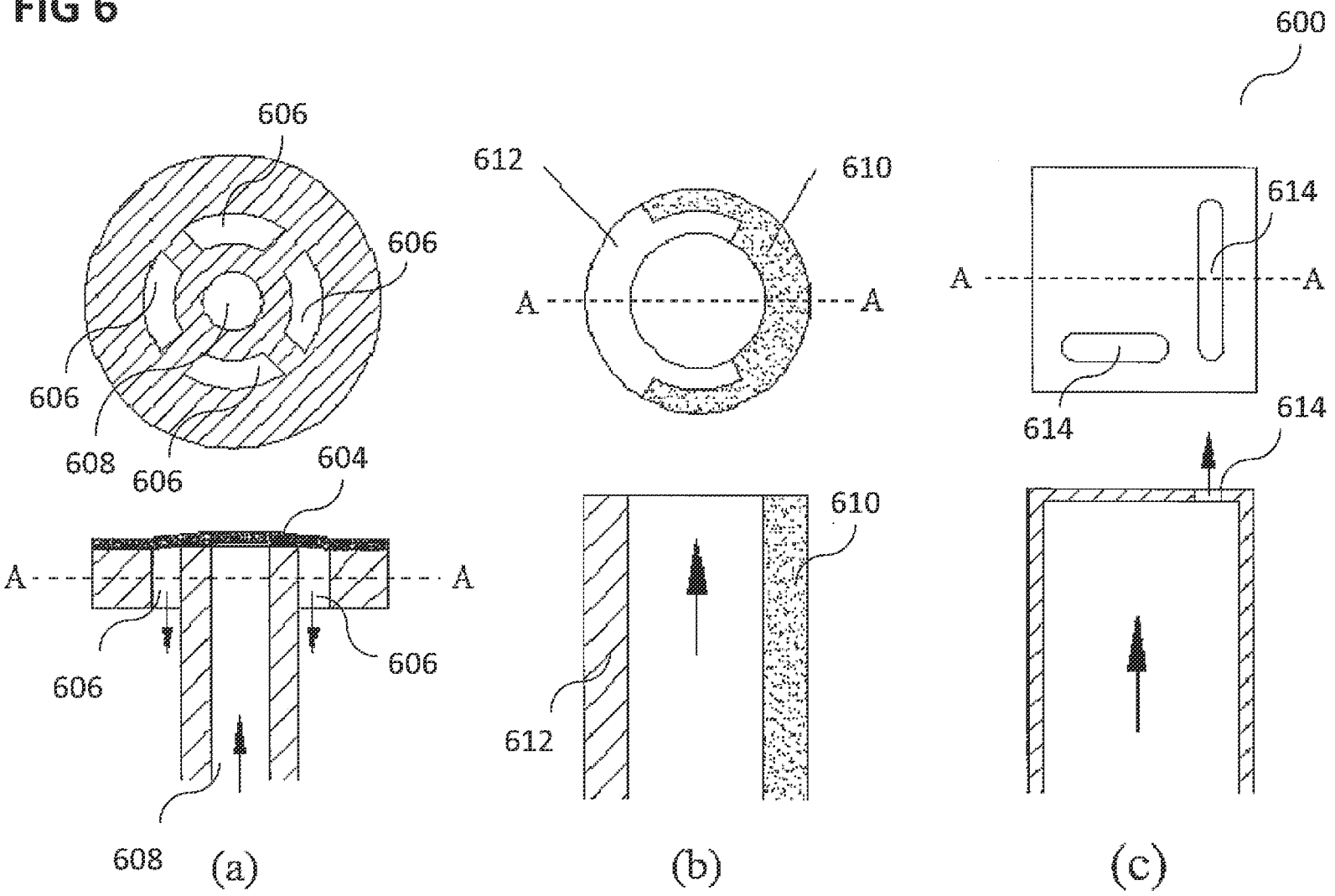
FIG. 6 shows an illustration of various micro-nozzle designs for flow pattern control according to various embodiments.

FIG. 6 shows an illustration 600 of various micro-nozzle designs for flow pattern control according to various embodiments. According to various embodiments, the elastic diaphragm 604 may be integrated with the nozzle to form an independent micro-agitator, as shown in portion (a) of FIG. 6. It may be used as a stand-alone agitation device for manipulating fluids in a detachable chip, for example as described in FIG. 4 or as described in FIG. 5. Depending on the design of the nozzle (for example the design of the air inlet 608 (or air inlets) and the air outlet 606 (or air outlets), different flow patterns may be achieved.

A further embodiment is shown in portion (b) of FIG. 6. For example, the nozzle may only partially be made of elastic material 610, while the rest 612 of the nozzle is made from non-elastic material.

A further embodiment is shown in portion (c) of FIG. 6. For example, multiple orifices 614 of different sizes and shapes may fabricated at the exit of the nozzle.

For the symmetrical designs as shown in FIG. 5 and portion (a) of FIG. 6, the oscillation of the diaphragm may mainly be in the vertical direction, causing a symmetrical vortex ring flow. For the non-symmetrical designs shown in portions (b) and (c) of FIG. 6, the resulting oscillation of the nozzle wall or the diaphragm may also exhibit a transverse wave motion, leading to more complicated chaotic flow.

Figure 7:
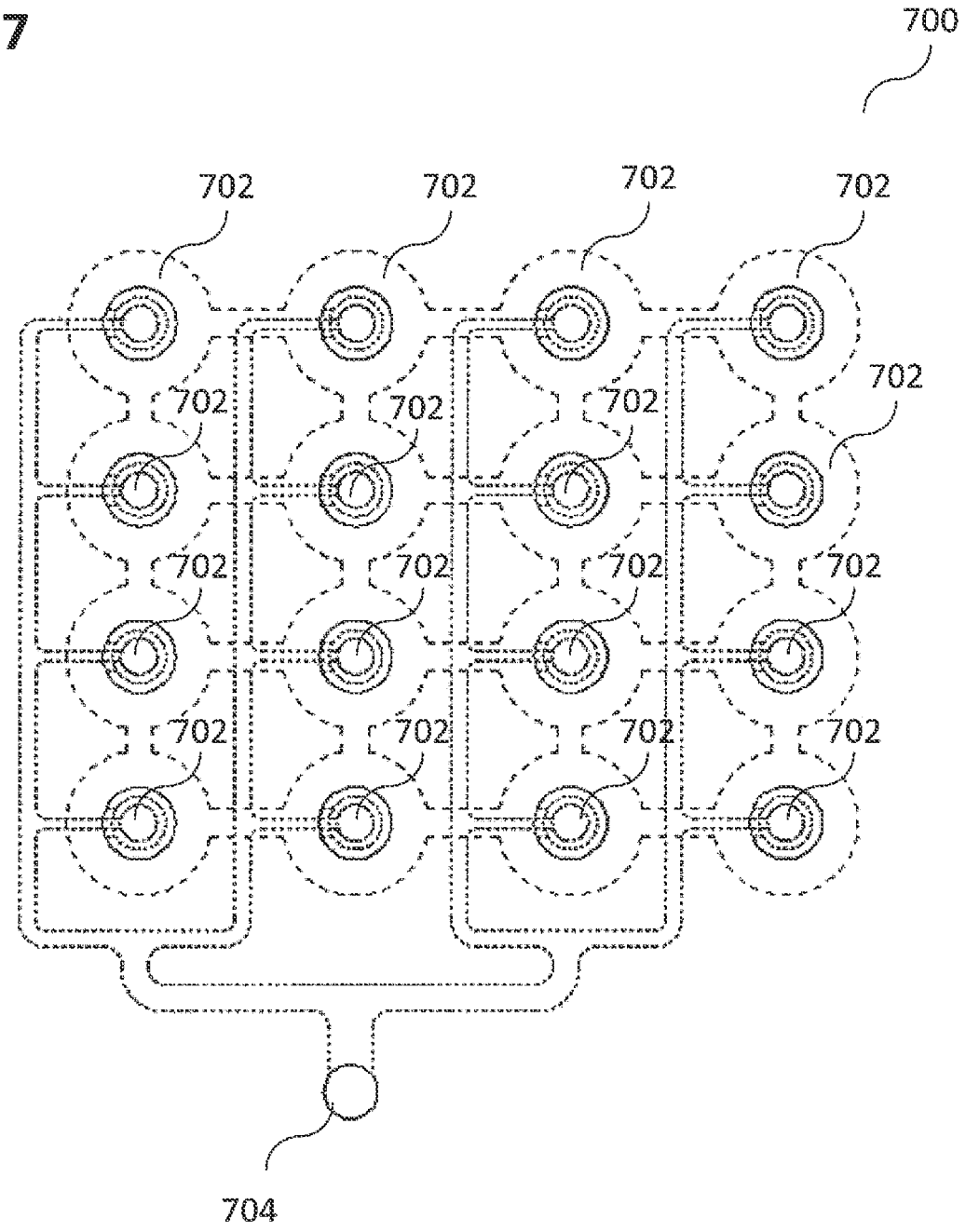
FIG. 7 shows a micro-chamber array according to various embodiments.

FIG. 7 shows a micro-chamber array 700 according to various embodiments. In other words, FIG. 7 shows a design for manipulating fluids in a micro-chamber array including a plurality of micro-chamber devices 702 (for example as shown in the previous figures) according to various embodiments. In the micro well array 700 as shown in FIG. 7, a larger flow rate of air may be provided (for example using a common air supply (or inlet) 704) to drive the multiple diaphragms for fluid manipulation in the micro wells.

Figure 8A:
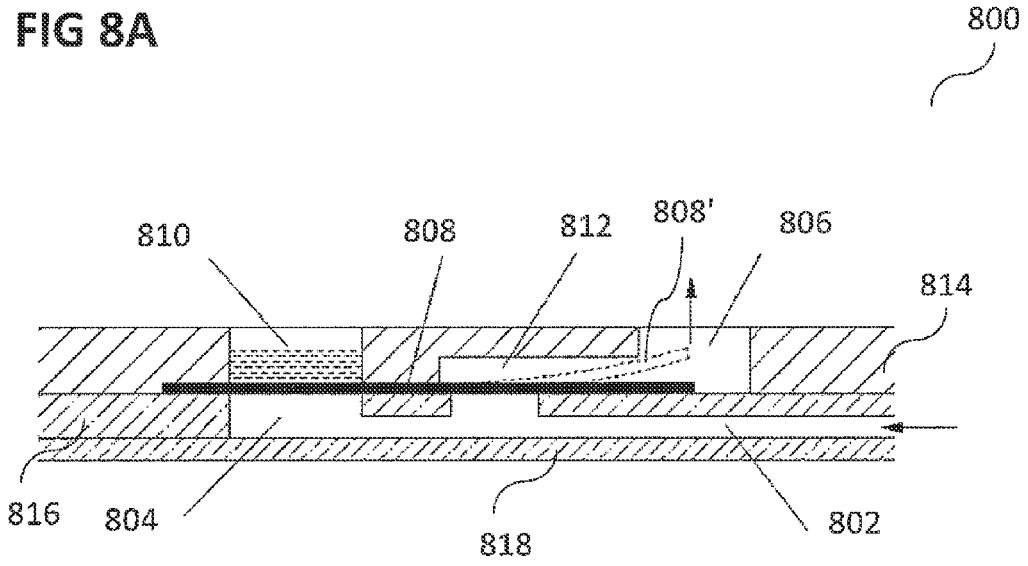
FIG. 8A to FIG. 8C show a front view, a top view and a 3D and cross-sectional view of a microfluidic agitator device according to various embodiments.
Figure 8B:
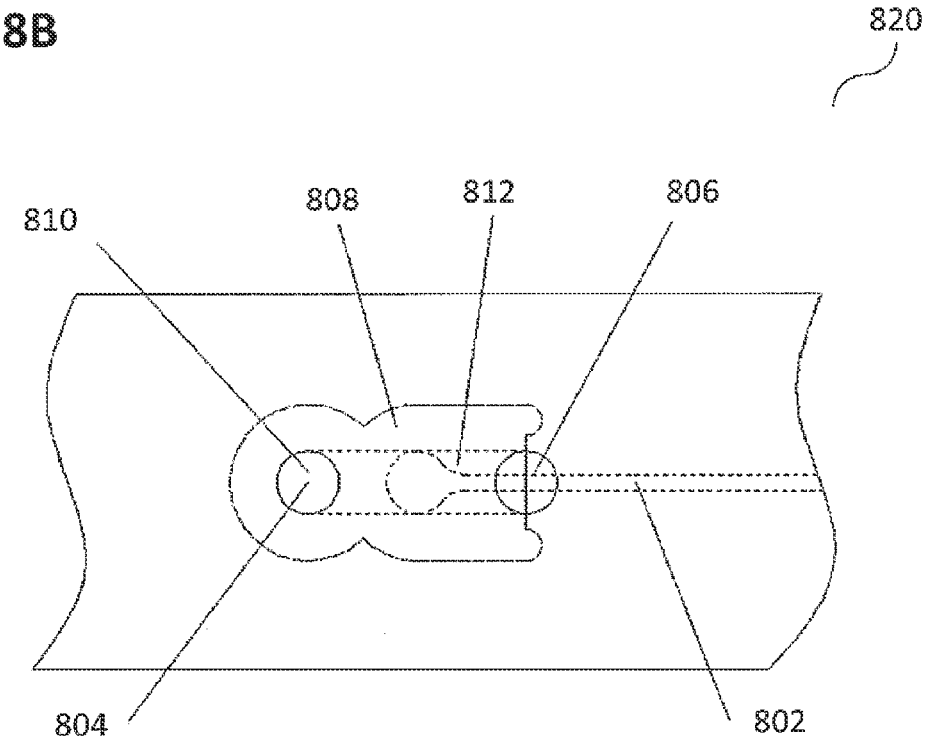
Figure 8C:
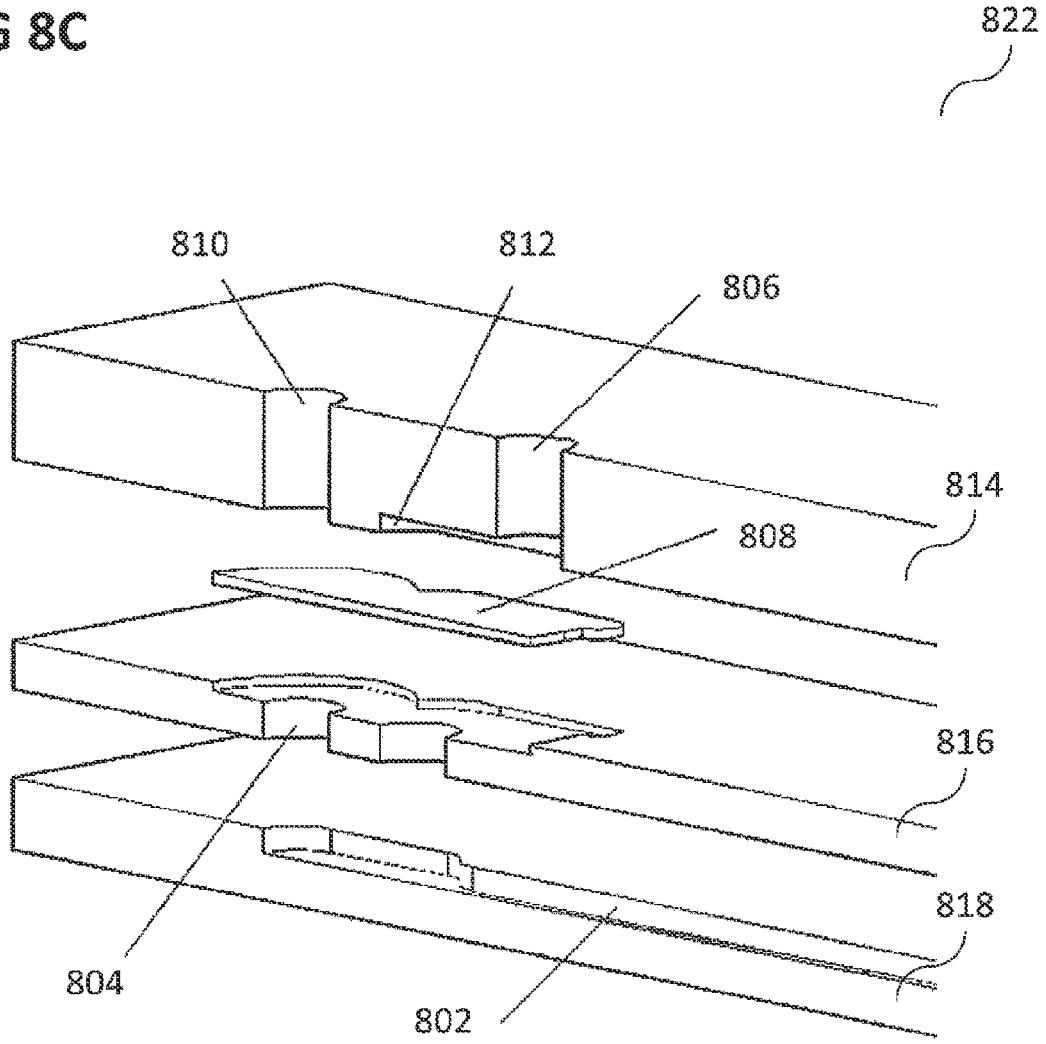

FIG. 8A shows a front view 800 of a further embodiment. FIG. 8B shows a top view 820 of the device of FIG. 8A according to various embodiments. FIG. 8C shows a 3D and cross-sectional view 822 of the device of FIG. 5A. An air inlet channel 802, an air cavity 804, an air outlet 806, an elastic diaphragm 808 (which is also shown in a deformed state 808'), a micro-chamber 810, a micro channel 812 are shown on a first substrate layer 814, a second substrate layer 816, and a third substrate layer 818.

The elastic diaphragm 808 may be clamped between two substrates (for example the first substrate layer 814 and the second substrate layer 816). Most of the edge of the elastic diaphragm 808 may be fixed except for the portion exposed to the air outlet 806. Initially, the elastic diaphragm 808 may be forced against the second-layer substrate 816. Thus, the air flow conduit may be closed. When an air pressure is applied to the diaphragm 808, it may deform into the channel 812 and the flow conduit may be open. The air may then be released and upstream pressure may be reduced. Next, the diaphragm 808 may move back under elastic force to close the conduit. Then the pressure may build up again until the diaphragm 808 is forced open. In this way, the alternating charge and release of air causes vibration of the elastic diaphragm 808. At the same time, the pressure fluctuations in cavity 804 may be transferred through the elastic diaphragm into the liquids in the chamber 810. According to various embodiments, the vibration may relate to the free-edge of the diaphragm 808 (which may for example be the part of the diaphragm 808 exposed to air outlet 806). The longer of the free vibration length, the stronger vibration may be produced. But generally, the agitation may be weaker in comparison with other embodiments. This embodiment may be used for manipulating low-viscosity liquids. The embodiment may be used for either open or closed chambers, and may be designed into a detachable configuration.

Figure 9:
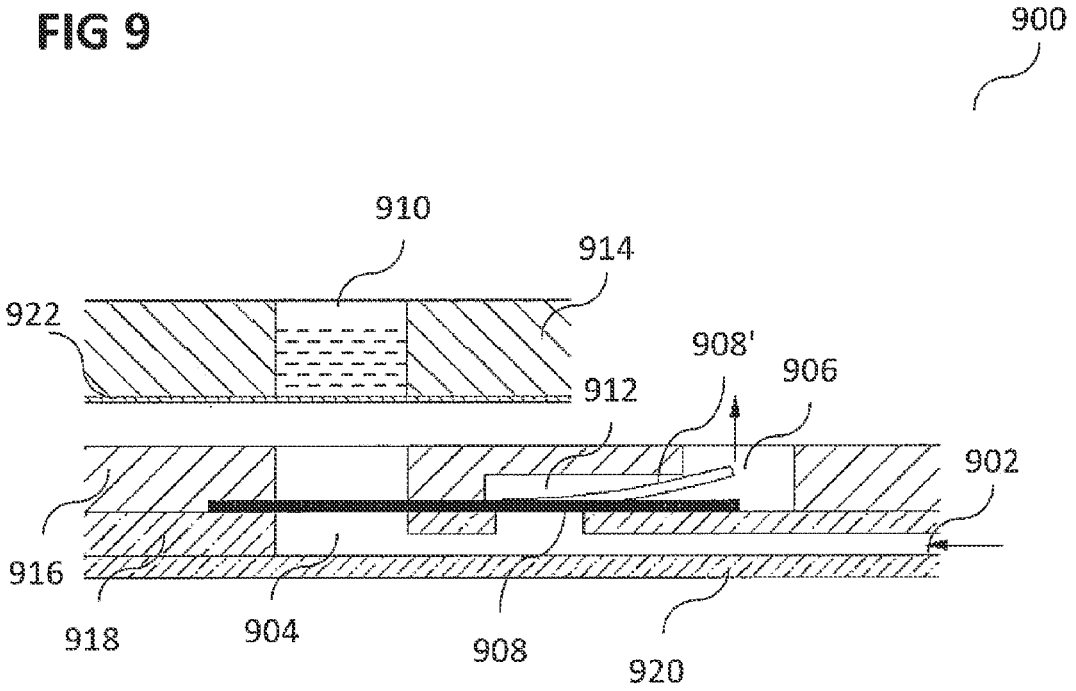
FIG. 9 shows a further detachable embodiment, with a fluid chamber located at upstream of the vibration diaphragm.

FIG. 9 shows a further detachable embodiment, with a fluid chamber 910 located at upstream of the vibration diaphragm (in other words: elastic diaphragm). An air inlet channel 902, an air cavity 904, an air outlet 906, an elastic diaphragm 908 (which is also shown in a deformed state 908'), the micro-chamber 910, and a micro channel 912 are shown on a first substrate layer 914, a second substrate layer 916, a third substrate layer 918, and a fourth substrate layer 920. As shown in FIG. 9, the chamber 910 may be placed upstream of the agitator. For example a thin flexible film 922 (as the chip in FIG. 4) or an elastic diaphragm (as the chip in FIG. 5) may be used for transferring the agitation energy into the liquids.

Figure 10:
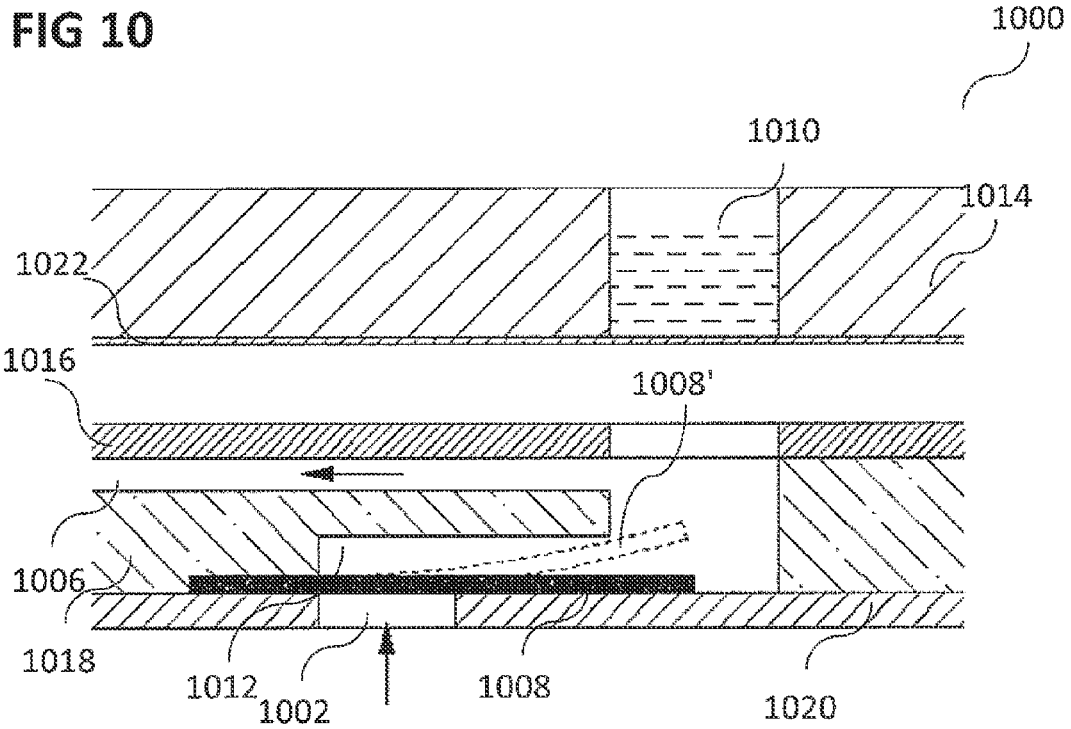
FIG. 10 shows a further detachable embodiment, with a fluid chamber located at downstream of the vibration diaphragm.

FIG. 10 shows a further detachable embodiment 1000, with a fluid chamber 1010 located at downstream of the vibration diaphragm 1010 (in other words: the elastic diaphragm). An air inlet channel 1002, an air outlet 1006, the elastic diaphragm 1008 (which is also shown in a deformed state 1008'), the micro-chamber 1010, and a micro channel 1012 are shown on a first substrate layer 1014, a second substrate layer 1016, a third substrate layer 1018, and a fourth substrate layer 1020. As shown in FIG. 10, the chamber 1010 may be placed downstream of the agitator. For example a thin flexible film 1022 (as the chip in FIG. 4) or an elastic diaphragm (as the chip in FIG. 5) may be used for transferring the agitation energy into the liquids.

In the following, a fabrication method for devices according to various embodiments will be described. The devices according to various embodiments may be realized with conventional layer-by-layer fabrication process. Mechanical clamping may be used for integration of elastic diaphragm into the chip. In the fabrication, PMMA material and thermal bonding technique may be used. First, a cavity slightly shallower than the thickness of the elastic diaphragm may be fabricated to hold the diaphragm. For example, a 200 μm-deep cavity may be used for 250 μm-thick silicone rubber. Then, air plasma treatment may be applied to clean the surface of PMMA substrates and to change its wettability properties as well. After alignment, the substrates, with the elastic diaphragm in position, may be sandwiched between two metal plates and put into two hot-platens with temperature and press control. Different from normal thermal bonding process, a higher temperature and a lower pressure may be applied. For PMMA, 109-110° C. and about 0.2 MPa may be used. After 7-10 minutes, the substrates may be well bonded. The elastic diaphragm may be tightly clamped between two PMMA layers and may seal the chamber. It is to be noted that above-mentioned parameters are merely an example for parameters for a fabrication process, but also parameters different from the above parameters may be used.

Besides PMMA and silicone rubber, the microfluidic device may also be fabricated with for example PC, COC, glass, or metal. For example natural rubber, thermoplastic polyurethane, latex, or nitrile rubber may be used for the elastic diaphragm.

In the following, production and properties of a device as illustrated in FIG. 2 will be described. The substrate material may be PMMA and the structure may be fabricated using a milling machine. The elastic diaphragm may be made of silicone rubber. It may be cut using a $CO_2$ laser.

For example, the main parameters of the device may be given as follows bellow (unit: mm):

Diameter/depth of the chamber: 3/2.5;

Diameter/thickness of the elastic diaphragm: 6/0.25;

Internal/outer diameter of the nozzle: 1.5/2.2;

Internal/outer diameter/circumferential angle of the air outlet (opening 206): 2.2/3/300°; and Width/depth of the air inlet channel: 0.4/0.5.

In the following, a mixing test will be described. One important application of current microfluidic agitator is for mixing enhancement. Testing was conducted to mix around 15 μl 99.5% glycerol (viscosity: about 1200 cP) and 0.5 μl food dye (viscosity: about 1 cP). Initially, the food dye stays on the surface of the glycerol. With an air flow at pressure about 0.6 bar, strong vibration of the silicone-rubber diaphragm may be produced, which may further cause a vortex/rotating flow. As a result, the liquids may quickly be mixed within just around 5 seconds. For benchmarking, a similar test was also conducted using different mixing devices, and relevant results are presented in Table 1. For a commercial vortex mixer, it is found that for the same liquids of same volume the mixing rate is slow. It requires around 20 minutes to get complete mixing. For acoustic mixing using a micro-speaker component, only slight mixing is obtained after 2 minutes. For ultrasonic mixing method using a piezoelectric disc, the mixing becomes even poorer. No clear mixing is observed after 2 minutes.

TABLE 1

Comparison of mixing about 15 μl glycerol with about 0.5 μl food dye in open micro-well using different devices

| Mixing Devices | Mixing results |
|---|---|
| Vortex mixer | 20 mins for complete mixing |
| Acoustic mixing using micro speaker | Slight mixing after 2 mins |
| Ultrasonic mixing using piezo-disc | Nearly no mixing after 2 mins |
| Microfluidic agitator mixer (current design) | 5 s to achieve complete mixing |

The device was also tested for stirring of solid particles. Applied liquid is 16 μl 90% glycerol solution with 10% water (viscosity: about 220 cP). Around 0.2 μl, 6 μm-diameter polystyrene (PS) microspheres (Fluoresbrite, Polysciences, Inc.) are added into the solution. The microparticles initially float on the surface of the glycerol. Under air pressure 0.35 bar, strong vortex flow may be produced. After around 5 seconds, the PS beads have been homogeneously dispersed into the whole liquid region.

In the following, particle focusing and/or enrichment will be described. As has been described above, different designs of the nozzle may be used to produce different flow patterns. According to various embodiments, the nozzle may be non-symmetrical. It may produce strong rotating/swirling flow in the chamber. It may be used for manipulating microparticles. Its application for particle focusing has been tested. The liquid is 85% glycerol solution with 15% water (viscosity: about 110 cP). 30-50 μm diameter glass beads initially deposit at chamber bottom. When the agitator is switched on at air pressure 0.6 bar, the glass beads are quickly stirred up and carried away by the rotating flow. Then swirling accumulation occurs. The glass beads quickly move inward, and accumulated at the center of the swirling flow after just 4 seconds.

According to various embodiments, a passive design that works in an active manner may be provided. According to various embodiments, the diaphragm may oscillate/vibrate spontaneously and consistently based on the aero-elasticity mechanism. It may be activated and maintained by an air flow. No external control may be required. In comparison with active designs, its structure may be simpler. It may be cheaper and more reliable.

According to various embodiments, a portable device for on-site applications may be provided. The operating pressure may be as low as 0.3 bar and the air flow rate may range from around 0.05 to 0.3 l/min. For certain applications, i.e. fluid mixing, it may just take a few seconds. Thus, a small pressurized tank may be enough to drive the device. It may even be operated with a common syringe through manually pushing the air through the device. Thus, the design may be an ideal tool for portable and on-site applications.

Various embodiments may be less dependent on liquid properties and workable for high-viscosity liquids. Since the agitation may be applied externally through an air flow, the operation of the device may be less dependent on the properties of the liquid under process. The agitation force may be large and adjustable, for example through changing the design parameter (for example the height of the micro nozzle), selection of elastic materials for the diaphragm, and/or controlling the upstream air pressure.

According to various embodiments, a high oscillation frequency may be provided. The frequency may typically be around several thousand Hertz, providing an advantage for many applications, such as fluid mixing and heat transfer enhancement.

Various embodiments may, as an external agitator, be applicable for either in-line continuous flow or for liquids in static chambers.

According to various embodiments, a microfluidic agitator may be provided including an air inlet passage, a micro-nozzle, an outlet, an elastic diaphragm and a micro chamber, whereas the elastic diaphragm may be clamped between the nozzle and the chamber. The micro-nozzle may be placed close to or against the diaphragm.

According to various embodiments, the diaphragm may be made of elastic materials such as silicone rubber, natural rubber, or latex.

According to various embodiments, the diaphragm may be just integrated with the nozzle to form an independent agitator device.

According to various embodiments, the micro-nozzle and the air outlet may have either symmetrical or non-symmetrical geometrically structures. The exit of the nozzle may include multiple orifices of different sizes.

According to various embodiments, the chamber may either be an open or a closed one.

According to various embodiments, a cavity may be provided between the nozzle and the chamber.

According to various embodiments, the micro-nozzle may be mountable to a supporting fixture with a thread track, and its position may be adjustable.

According to various embodiments, the micro-nozzle may be made, or partially made, of elastic materials.

According to various embodiments, the edge of the diaphragm may only be partially fixed. The portion exposed to the air outlet may be forced against the surface of the substrate, and may deform under pressure to form a flow conduit.

According to various embodiments, the microfluidic agitator device may be used as a platform for fluid manipulations. The microfluidic chip may be attached to or moved away from it.

According to various embodiments, the microfluidic chip may include a chamber or channel. An elastic diaphragm or a thin flexible film may be used as the interface between the agitator and liquids.

According to various embodiments, the device may be extended into an array of micro-chambers-wells.

While the invention has been particularly shown and described with reference to specific embodiments, it should be understood by those skilled in the art that various changes in form and detail may be made therein without departing from the spirit and scope of the invention as defined by the appended claims. The scope of the invention is thus indicated by the appended claims and all changes which come within the meaning and range of equivalency of the claims are therefore intended to be embraced.

What is claimed is:

1. A microfluidic agitator device comprising:

an air inlet;

an air outlet;

an elastic diaphragm provided between the air inlet and the air outlet and configured to oscillate with an oscillation frequency if an airflow from the air inlet to the air outlet is provided;

a chamber coupled to the elastic diaphragm; and a nozzle;

wherein a gap is provided between the nozzle and the elastic diaphragm, and wherein the diaphragm is configured to be pushed back towards the nozzle due to an accelerated air flow and to be pushed away from the nozzle when the gap is closed so that an oscillation of the diaphragm forms.

2. The microfluidic agitator device of claim 1, wherein the elastic diaphragm is clamped between the nozzle and the chamber.

3. The microfluidic agitator device of claim 1, wherein the chamber is configured to hold a fluid to be agitated.

4. The microfluidic agitator device of claim 1, wherein the elastic diaphragm comprises at least one of silicone rubber, natural rubber, or latex.

5. The microfluidic agitator device of claim 2, wherein the elastic diaphragm is integrated with the nozzle.

6. The microfluidic agitator device of claim 2, wherein the nozzle and the air outlet comprise symmetrical geometrically structures.

7. The microfluidic agitator device of claim 2, wherein the nozzle and the air outlet comprise non-symmetrical geometrically structures.

8. The microfluidic agitator device of claim 2, wherein an exit of the nozzle comprises a plurality of orifices of different sizes.

9. The microfluidic agitator device of claim 1, wherein the chamber is an open chamber.

10. The microfluidic agitator device of claim 1, wherein the chamber is a closed chamber.

11. The microfluidic agitator device of claim 2, further comprising:

a cavity between the nozzle and the chamber.

12. The microfluidic agitator device of claim 2, wherein the nozzle is mountable to a supporting fixture with a thread track; and wherein the position of the nozzle with respect to the elastic diaphragm is adjustable.

13. The microfluidic agitator device of claim 2, wherein the nozzle comprises an elastic material.

14. The microfluidic agitator device of claim 2, wherein the elastic diaphragm is partially fixed; and wherein a portion of the elastic diaphragm exposed to the air outlet is configured to deform under a pressure to form a flow conduit.

15. The microfluidic agitator device of claim 1, further comprising:

a receiver configured to receive a chip, the chip comprising the chamber.

16. An array of microfluidic agitator devices, comprising a plurality of microfluidic agitator devices of claim 1.

* * * * *